US005860376A

United States Patent [19]

Tseng

[11] Patent Number: 5,860,376

[45] Date of Patent: Jan. 19, 1999

[54] THREAD TENSION DEVICE FOR SEWING MACHINE

[76] Inventor: Hsien Chang Tseng, 9F., No. 270, Gau Gong Road, Taichung, Taiwan

[21] Appl. No.: 951,354

[22] Filed: Oct. 16, 1997

[51] Int. Cl.[6] ..... D05B 47/02

[52] U.S. Cl. ..... 112/255

[58] Field of Search ..... 112/254, 255, 112/302, 162, 165, 166, 475.26

[56] References Cited

U.S. PATENT DOCUMENTS

| | | | |
|---|---|---|---|
| 4,300,465 | 11/1981 | Tsuboi | 112/255 |
| 4,726,308 | 2/1988 | Aida et al. | 112/254 |
| 4,803,936 | 2/1989 | Mikuni et al. . | |
| 4,815,404 | 3/1989 | Ellermann et al. | 112/255 X |
| 5,156,105 | 10/1992 | Wang | 112/254 |
| 5,265,548 | 11/1993 | Satoma . | |

FOREIGN PATENT DOCUMENTS

| | | | |
|---|---|---|---|
| 2148689 | 7/1987 | Japan | 112/254 |
| 6-091071 | 4/1994 | Japan | 112/254 |

*Primary Examiner*—Ismeal Izaguirre
*Attorney, Agent, or Firm*—Charles E. Baxley, Esq.

[57] ABSTRACT

A thread tension device for a sewing machine includes two or more pairs of discs for engaging with two or more threads. Two or more tension applying members are engaged with the pairs of discs for applying a biasing force against the pairs of discs. Two or more micro-adjusting mechanisms are engaged with the tension applying embers for adjusting the biasing force against the pairs of discs. An actuator is engaged with the micro-adjusting mechanisms for actuating the micro-adjusting mechanisms simultaneously.

16 Claims, 6 Drawing Sheets

THREAD TENSION DEVICE FOR SEWING MACHINE

BACKGROUND OF THE INVENTION

1. Field of the Invention

The present invention relates to a thread tension device, and more particularly to a thread tension device for a sewing machine, particularly an overlock sewing machine or an overedge sewing machine.

2. Description of the Prior Art

A typical thread tension device for an overedge sewing machine is disclosed in U.S. Pat. No. 4,803,936 to Mikuni et al. and comprises a number of tension disc assemblies disposed on a shaft for clamping the threads and each including a first thread tension setting device for setting the spring force against the pair of disc of the tension disc assemblies, and each including a second thread tension setting device for adjusting the tension of the first thread tension setting device, and each further including a thread tension releasing device for releasing the spring forces to the tension disc assemblies. The thread tension of one or more of the tension disc assemblies may be released simultaneously.

Another typical thread tension device for an overlock sewing machine is disclosed in U.S. Pat. No. 5,265,548 to Satoma and also comprises a thread tension unit for clamping a thread to apply tension, a first thread tension setting device for setting the thread tension unit to apply a preset thread tension, a second thread tension setting device for adjusting the tension applied by the thread tension unit to an optional tension, and a thread tension nullifying device for nullifying the setting made by the second thread tension setting means. The thread tension nullifying devices each includes a pair of rocking bodies directly engaged with a cam body such that each of the thread tension units requires a whole set of rocking bodies and cam body.

In both of the prior arts, a whole set of tension releasing device or nullifying device is required to be provided for each pair of the clamping discs such that a number sets of identical tension releasing or tension nullifying devices are required to be engaged in the upper portion of the sewing machine. However, the upper portion of the sewing machine normally includes a compact or tiny space that may not be easily installed with so many elements and members.

The present invention has arisen to mitigate and/or obviate the afore-described disadvantages of the conventional tension devices for sewing machines.

SUMMARY OF THE INVENTION

The primary objective of the present invention is to provide a thread tension device which includes a simplified configuration for operating a number of thread tension devices simultaneously which are provided for applying thread tensions to the clamping discs for the threads.

In accordance with one aspect of the invention, there is provided a thread tension device for a sewing machine, the thread tension device comprises two poles provided in the sewing machine, two pairs of discs engaged on the poles respectively for clamping threads, guiding means for engaging with the discs and for guiding the discs to move along the poles respectively and for preventing the discs from rotating relative to the poles, two biasing means engaged with the pairs of discs respectively for applying a biasing force against the pairs of discs and for applying thread tensions to the threads, two micro-adjusting mechanisms engaged with the first biasing means for adjusting the biasing force of the biasing means against the pairs of discs, and a recovering means for actuating the micro-adjusting mechanisms simultaneously.

An adjusting means comprises a rod rotatably supported in the sewing machine, two cams secured on the rod and rotated in concert with the rod, two levers pivotally secured in the sewing machine and including a first end for engaging with the cams and including a second end for engaging with the biasing means and for adjusting the biasing force of the biasing means against the pairs of discs when the cams are rotated by the rod. The adjusting means includes two panels engaged on the poles and engaged with the first biasing means, and includes two gears rotatably engaged on the poles and threadedly engaged with the panel for allowing the panels to be moved toward and away from the first biasing means when the gears are rotated, the second ends of the levers are engaged with the gears for adjusting the biasing force of the biasing means against the pairs of discs when the cams are rotated. The guiding means includes two pins secured in the sewing machine and extended parallel to the poles respectively, the pins are engaged with the pairs of discs and engaged with the panels for guiding the discs and the panels to move along the poles and for preventing the discs and the panels from rotating relative to the poles respectively.

The micro-adjusting mechanisms each includes a dial engaged with the gears and for rotating the gears and for moving the panels against the first biasing means when the dials are rotated. The dials of the micro-adjusting mechanisms each includes an internal gear, and a second gear engaged with the internal gear, and means for biasing the second gear to engage with the internal gear and for allowing the second gear to be disengaged from the dial. The second gears each includes a hand grip for allowing a user to move the second gear away from the dial and for allowing the gears to be rotated freely by the dials. The second gears each includes a protrusion, the recovering means includes two rotary members rotatably supported in the sewing machine for engaging with the protrusions of the second gears and for recovering the protrusions and the second gears. The recovering means includes a third gear rotatably supported in the sewing machine, a fourth gear secured on the rod and engaged with the third gear for allowing the third gear to rotate the rod and the rod and the cams.

The recovering means includes a third gear rotatably supported in the sewing machine and an actuator rotatable secured to the rod for engaging with the rotary members, the actuator includes a projection for engaging with the third gear, and means for biasing the projection to engage with the third gear and for allowing the third gear to rotate the actuator and for allowing the actuator to actuate the rotary members simultaneously. The actuator includes two screws threadedly engaged thereon for engaging with the rotary members, the screws are adapted to he adjusted relative to the actuator. The recovering means includes two arms rotatably engaged on the rod, the actuator is secured to the arms and rotated in concert with the arms.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
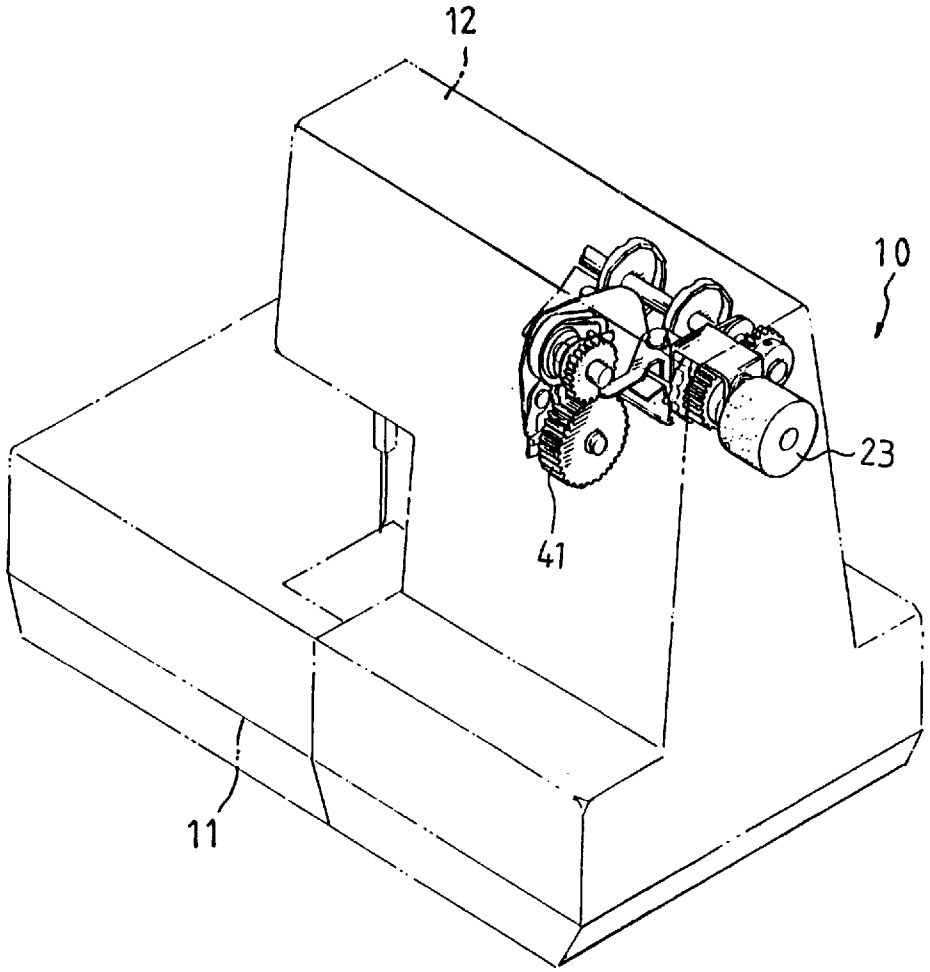
FIG. 1 is a partial perspective view showing a position of a thread tension device in accordance with the present invention in a sewing machine.

Referring to the drawings, and initially to FIG. 1, a thread tension device in accordance with the present invention is disposed on the upper portion or the upper arm 12 of the sewing machine 10, particularly an overlock sewing machine or an overedge sewing machine, which includes a bottom 11 for accommodating the main parts of the sewing machine. The thread tension device includes a knob 23 extended outward from the side portion of the sewing machine 10 and includes two or more dials 41 partially extended outward from the front portion of the sewing machine 10 for allowing the user to rotate the dials 41 and to adjust the thread tensions to the threads.

Figure 2:
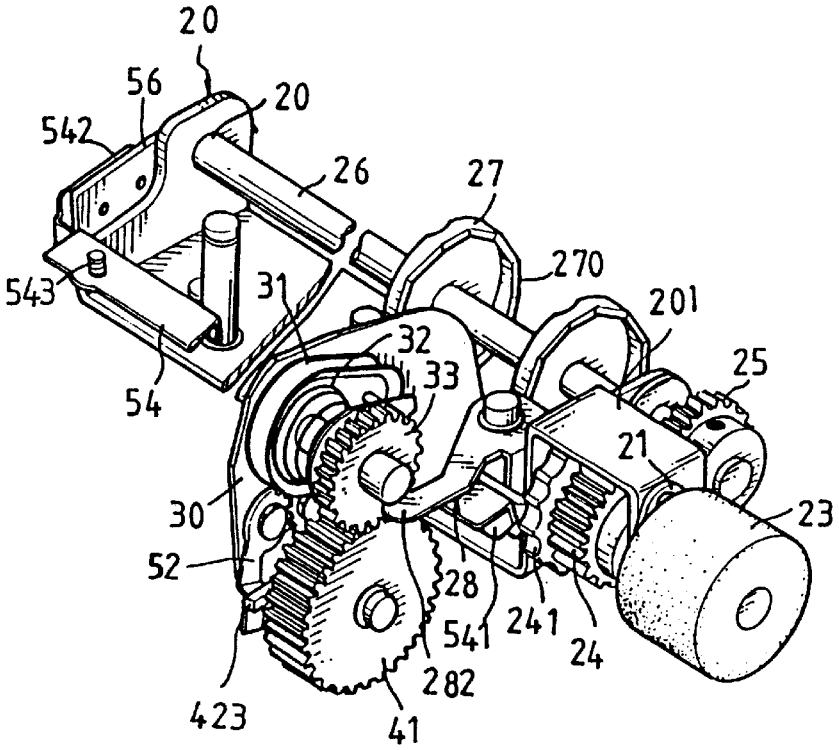
FIG. 2 is a perspective view of the thread tension device.
Figure 3:
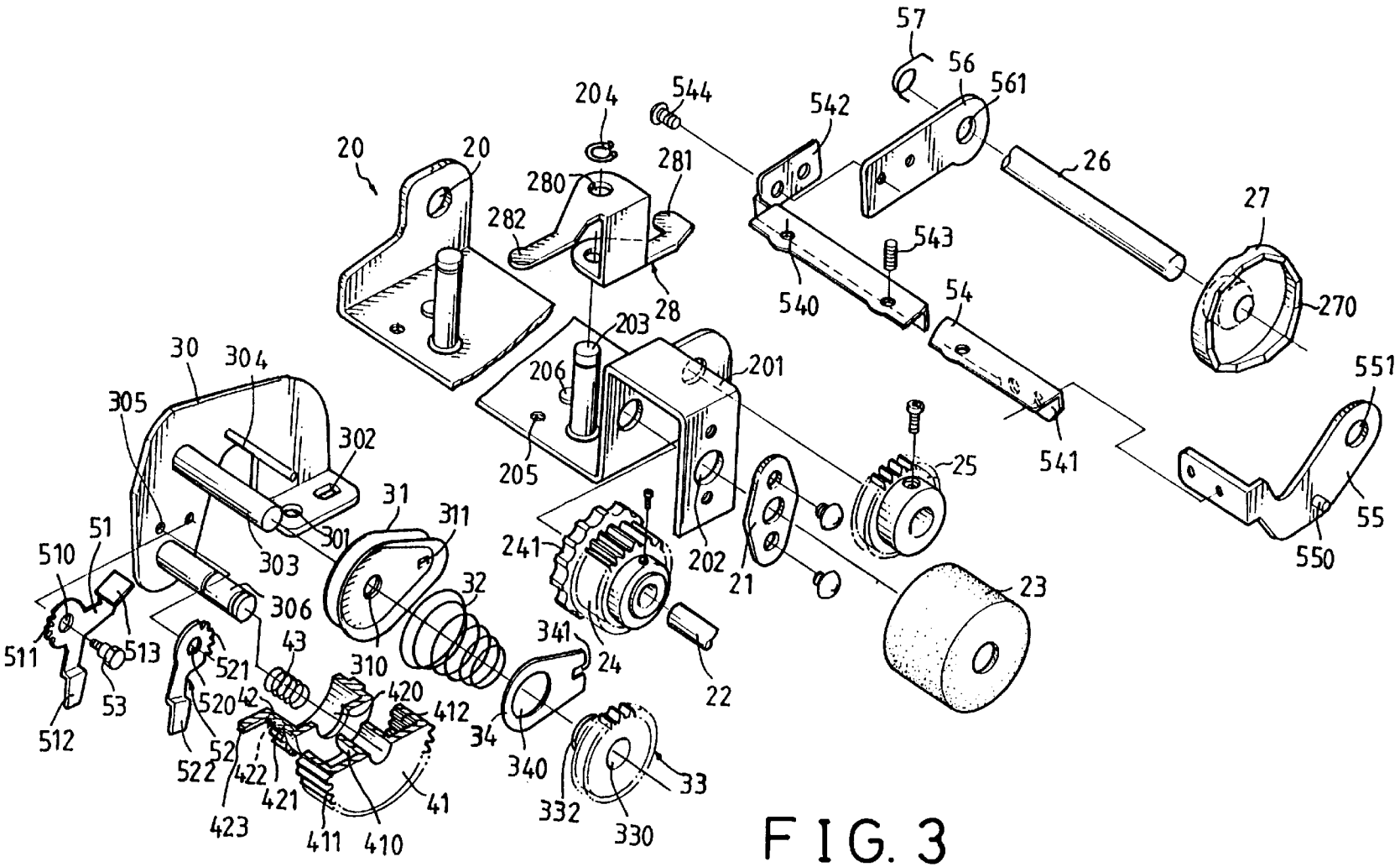
FIG. 3 is an exploded view of the thread tension device.
Figure 4:
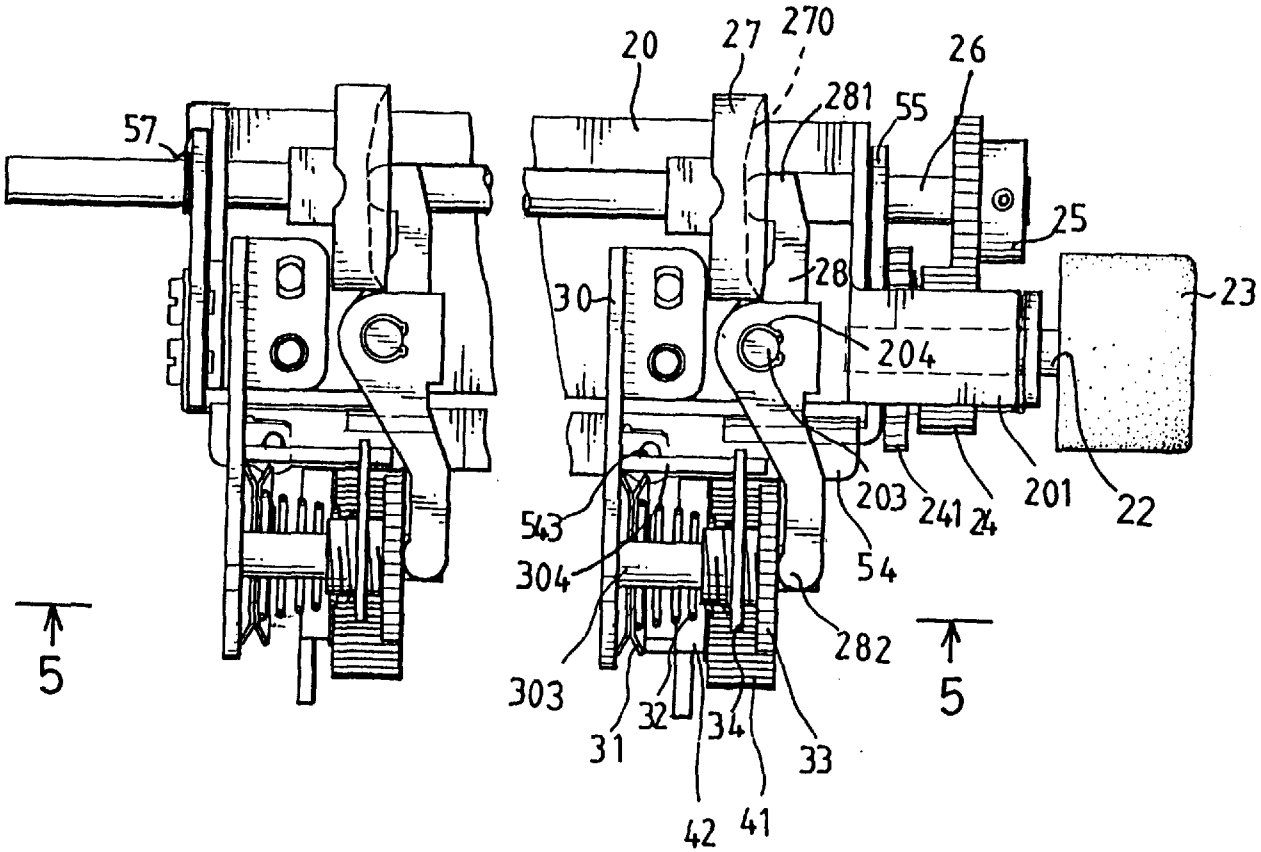
FIG. 4 is a partial top view of the thread tension device.
Figure 5:
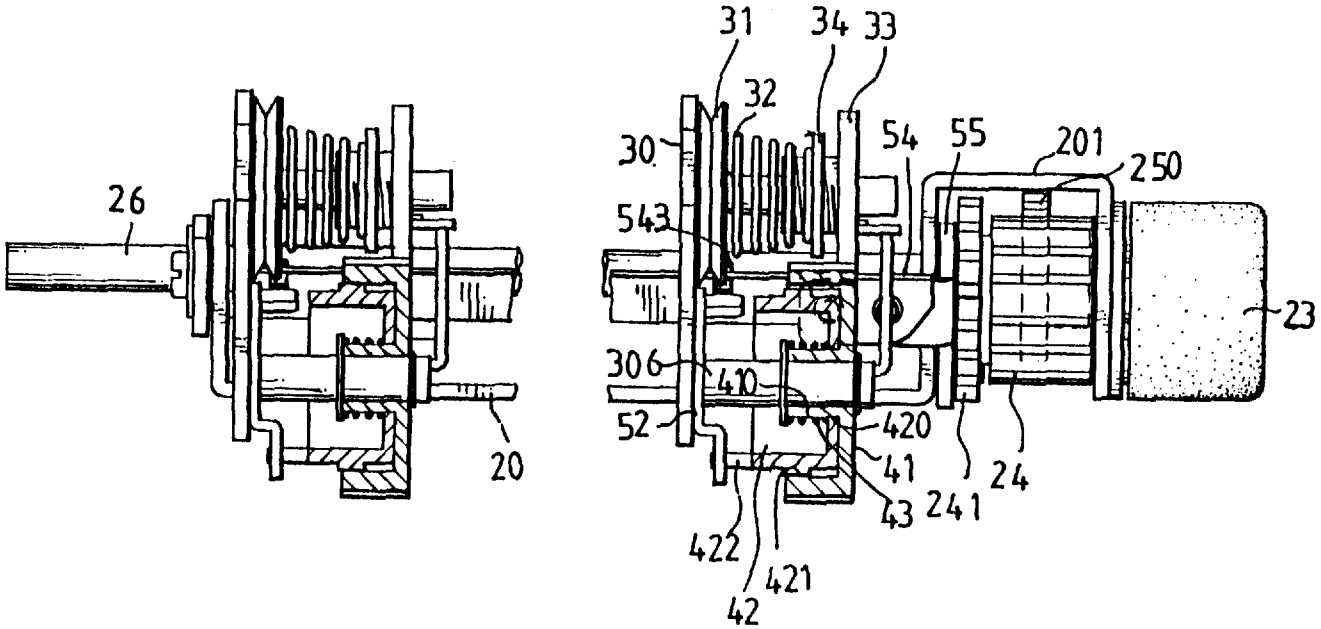
FIGS. 5 and 7 are partial cross sectional views taken along lines 5—5 of FIG. 4.
Figure 7:
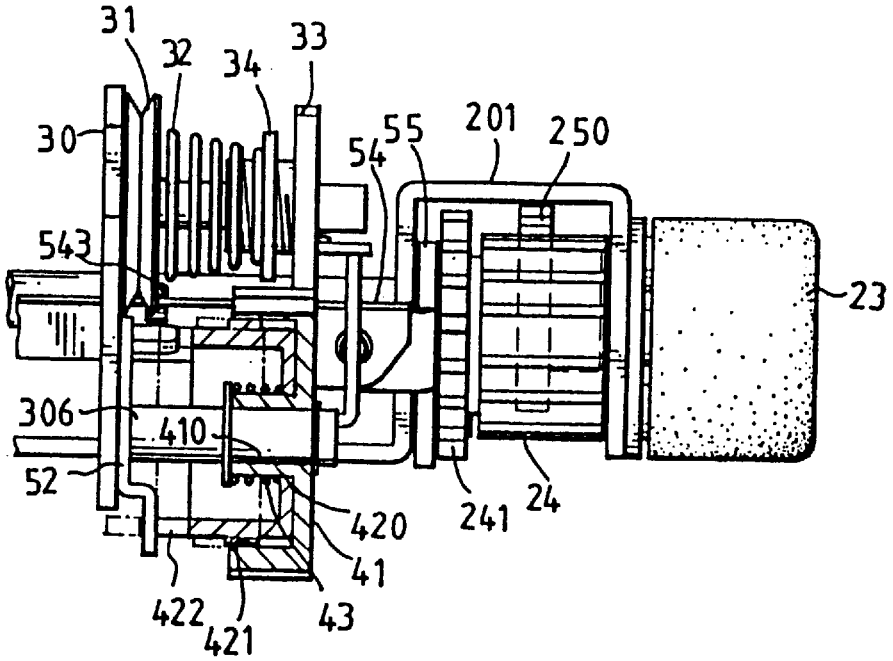

Referring next to FIGS. 2–4, the thread tension device comprises a rod 26 rotatably supported in the upper portion of the sewing machine. One or more cams 27 are secured on the rod 26 and each includes a number of cam surfaces 270. A gear 25 is secured on the rod 26 and rotated in concert with the rod 26 and the cams 27. A U-shaped support 20 is secured in the sewing machine and includes two holes 200 for engaging with the rod 26 and includes an inverse U-shaped bracket 201 provided on one side. The support 20 includes two or more posts 203 extended upward and two or more screw holes 205 and bulges 206 formed beside the post, 203. One or more levers 28 each includes a middle portion 280 rotatably engaged on the post 203 and secured in place by clamping rings 204 and each includes two ends 281, 282, in which one of the ends 281 is engaged with the cam surfaces 270 (FIG. 4).

Two arms 55, 56 each includes a hole 551, 561 for rotatably engaging on the rod 26. An actuator 54 includes two ends 541, 542 secured to the arms 55, 56 and includes two or more screw holes 540 for engaging with screws 543 which may he adjusted upward and downward relative to the actuator 54. The actuator 54 and the arms 55, 56 may be formed as an integral part. The arm 55 includes a projection 550 for engaging with the gear 241. A spring 57 is engaged with the arm 56 for biasing the actuator 54 upward and for biasing the projection 550 to engage with the gear 241 (FIGS. 6, 8) and for allowing the actuator 54 to be rotated about the rod 26 and to be moved downward by the projection 550 when the gear 241 is rotated by the knob 23.

The bracket 201 includes two holes 202 for rotatably engaging with a shaft 22. The knob 23 is secured to the shaft 22 for rotating the shaft 22. Two gears 24, 241 are secured on the shaft 22 and rotated in concert with the shaft 22, in which the gear 24 is engaged with the gear 25 for allowing the knob 23 to rotate the rod 26 via the gears 24, 25. The hole 202 which is closer to the knob 23 preferably includes a size larger than the shaft 22 for allowing the shaft 22 to be slightly adjusted in the hole 202. A board 21 is provided for rotatably supporting the shaft 22 and for adjusting the shaft 22 relative to the hole 202 and for allowing the gear 24 to be solidly engaged with the gear 25 before the shaft 22 and the board 21 are secured to the bracket 201.

One or more seats 30 are secured to the support 20 and each includes a hole 302 for engaging with the bulge 206 and each includes a hole 301 for aligning with the screw hole 205 and for engaging with fasteners and for allowing the seats 30 to be solidly secured to the support 20. The seats 30 each includes a pole 303, a bar 306 and a pin 304 parallel to the shaft 22. A pair of discs 31 each includes a hole 310 for engaging on the pole 303 and each includes a puncture 311 for engaging with the pin 304 which may guide the discs 31 to move a along the pole 303 only and may prevent the discs 31 from rotating relative to the pole 303. A panel 34 includes a screw a hole 340 engaged on the pole 303 and includes a notch 341 for engaging with the pin 304 which may also prevent the panel 34 from rotating relative to the pole 303. A spring 32 is biased between the panel 34 and the discs 31 for applying a biasing force against the discs 31 and for clamping a thread between the discs 31. A gear 33 includes a hole 330 rotatably engaged on the pole 303 and includes a stud 332 having an outer thread for engaging with the screw hole 340 and for allowing the gear 33 to move the panel 34 toward or away from the discs 31 and to adjust the biasing force against the discs 31 by the spring 32 when the gear 33 is roatated. The other end of the lever 28 is engaged with the gear 33 for allowing the lever 28 to adjust the gear 33 along the pole 303 (FIGS. 2 and 4) when the cams 27 and the rod 26 are rotated by the knob 23.

The dial 41 includes a hub 410 rotatably engaged on the bar 306 and includes a number of teeth 411 for engaging with the gear 33 and for allowing the dial 41 to rotate the gear 33 in order to adjust the panel 34 against the spring 32 and in order to adjust the tension applied to the discs 31. The dial 41 includes an internal gear 412. A gear 42 includes a hole 420 for rotatably engaging on the hub 410 of the dial 41 and includes a number of teeth 421 for engaging with the teeth 412 of the dial 41. A spring 43 may bias the gear 42 to engage with the internal gear 412. The gear 42 includes a hand grip 423 extended forward for allowing the gear 42 to be moved against the spring 43 and to be disengaged from the dial 41 and for allowing the gear 42 to be rotated and adjusted relative to the dial 41 when the gear 42 is disengaged from the gear 41. The gear 42 includes a protrusion 422 extended toward the seat 30 and extended away from the gear 41 (FIGS. 5–8).

Figure 6:
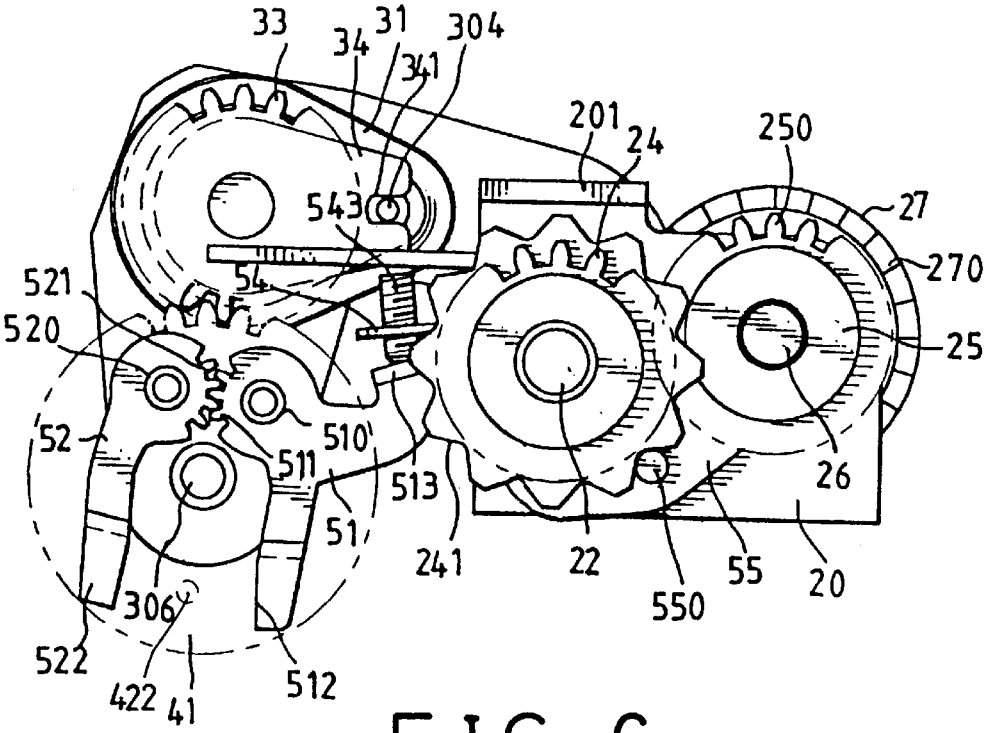
FIGS. 6 and 8 are side schematic views illustrating the operation of the thread tension device.
Figure 8:
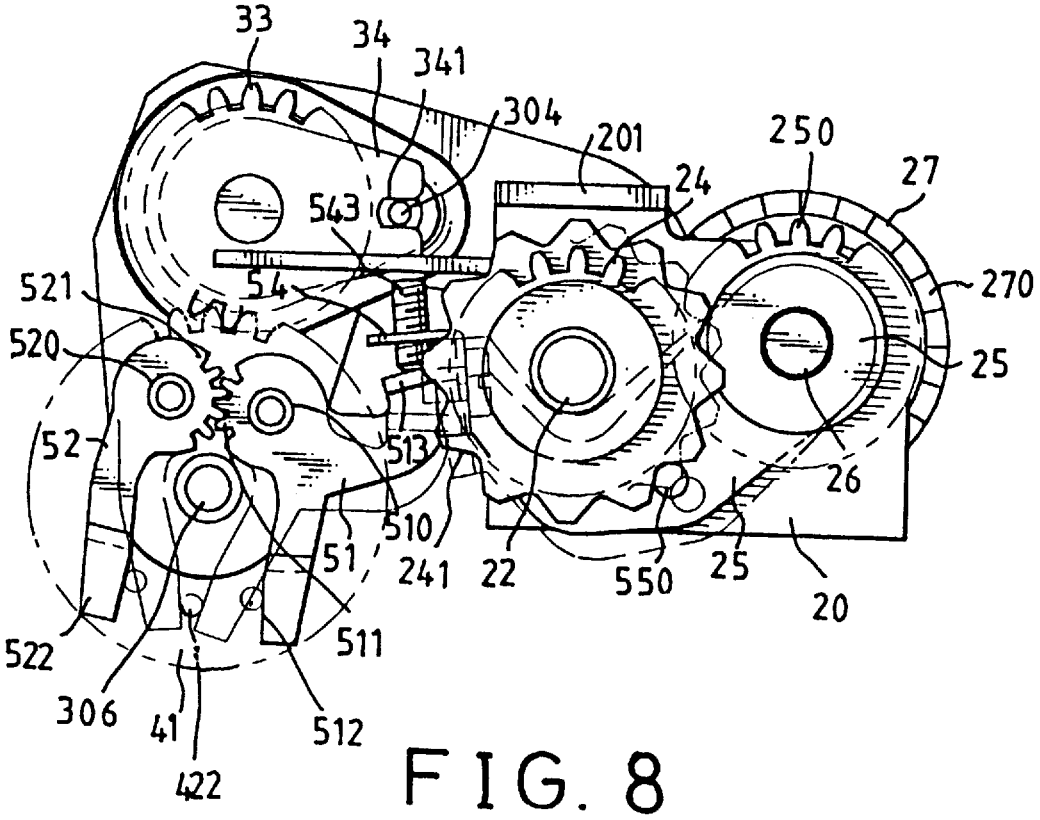

A pair of rotary members 51, 52 each includes a hole 510, 520 for engaging with a fastener 53 which is threaded to a screw hole 305 of the seat 30. The rotary members 51, 52 each includes a number of teeth 511, 521 engaged with each other for allowing the rotary member 52 to be rotated by the other rotary member 51 when the rotary member 51 is rotated. The rotary members 51, 52 each includes a leg 512, 522 for engaging with the protrusion 422 of the gear 42 and for recovering the gears 42, 41 (FIGS. 6, 8 ). The rotary member 51 includes an extension 513 for engaging with the screw 543 of the actuator 54 (FIGS. 6, 8) and for allowing the gears 51, 52 to be rotated by the actuator 54 and for allowing the actuator 54 to engage with and to recover the protrusion 422 and thus to recover the gears 41, 42.

In operation, as shown in FIG. 4, the gears 33 may be moved along the respective poles 303 against the spring 32 by the levers 28 and the cams 27 when the rod 26 is rotated by the knob 23, such that the biasing force of the springs 32 against the discs 31 may thus be adjusted and set. The dials 41 may then be rotated by the user for rotating the gears 33 and for moving the panels 34 against the springs 32 and for micro-adjusting the biasing force of the springs 32 against the discs 31. Normally, the dials 41 may be rotated for only about sixty degrees. If the limited rotation of the dial 41 is not good enough for adjusting the biasing force against the discs 31, the gear 42 may he disengaged from the gear 41 by the hand grip 423 for allowing the gear 41 to be rotated freely to rotate the gear 33 and to adjust the biasing force against the discs 31. After the micro-adjustment by the gears 41 and/or 42, the gears 41, 42 and the protrusions 422 of the gears 42 will be rotated and disengaged from the original central position. When the user is going to conduct another stitch operations and when the knob 2 is rotated by the user, the rod 26 and the cams 27 may be rotated in order to move the gears 33 against the springs 32 simultaneously. The gear 241 may also be rotate by the knob 23 simultaneously for rotating the actuator 54 by the projection 550 and for allowing the screws 543 of the actuator 54 to actuate the rotary members 51, 52 and for allowing the legs 512. 522 of on the rotary members 51, 52 to move and to recover the protrusion 422 and the gears 41, 42 to the original central position (FIG. 8).

It is to be noted that, without the gear 42, the protrusion 422 may be directly extended from the gear 41 and may be actuated by the rotary member 51, 52 for allowing the gear 41 to be recovered to the original central position. It is further to be noted that only one gear 241 is required for actuating the only actuator 54 which may be used for actuating and for recovering two or more sets of gears 41, 42.

Accordingly, the thread tension device in accordance with the present invention includes a simplified configuration for operating a number of thread tension devices simultaneously.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A thread tension device for a sewing machine, said thread tension device comprising:

at least two poles provided in the sewing machine, two pairs of discs engaged on said at least two poles respectively for clamping threads, at least two first biasing means engaged with said pairs of discs respectively for applying a biasing force against said pairs of discs and for applying thread tensions to the threads, at least two micro-adjusting mechanisms engaged with said at least two first biasing means for adjusting the biasing force of said at least two first biasing means against said pairs of discs, a recovering means for actuating said at least two micro-adjusting mechanisms simultaneously and for allowing said at least two micro-adjusting mechanisms to be recovered to an original position, means for adjusting the biasing force of said at least two first biasing means against said pairs of discs, said adjusting means including a rod rotatably supported in the sewing machine, at least two cams secured on said rod and rotated in concert with said rod, at least two levers pivotally secured in the sewing machine and having a first end for engaging with said at least two cams and having a second end for engaging with said at least two biasing means and for adjusting the biasing force of said at least two biasing means against said pairs of discs when said cams are rotated by said rods, said adjusting means including at least two panels engaged on said at least two poles and engaged with said at least two first biasing means, and including at least two gears rotatably engaged on said at least two poles and threadedly engaged with said panel for allowing said at least two panels to be moved toward and away from said at least two first biasing means when said at least two gears are rotated, said second ends of said at least two levers are engaged with said at least two gears for adjusting the biasing force of said at least two biasing means against said at least two pairs of discs when said cams are rotated.

2. The thread tension device according to claim 1 further comprising a guiding means including at least two pins secured in the sewing machine and extended parallel to said at least two poles respectively and engaged with said at least two pairs of discs and engaged with said at least two panels for guiding said at least two discs and said at least two panels to move along said at least two poles and for preventing said at least two discs and said at least two panels from rotating relative to said at least two poles respectively.

3. The thread tension device according to claim 1, wherein said at least two micro-adjusting mechanisms each includes a dial engaged with said at least two gears and for rotating said at least two gears and for moving said at least two panels against said at least two first biasing means when said dials are rotated.

4. The thread tension device according to claim 3, wherein said dials of said at least two micro-adjusting mechanisms each includes an internal gear, and a second gear engaged with said internal gear, and means for biasing said second gear to engage with said internal gear and for allowing said second gear to be disengaged from said dial.

5. The thread tension device according to claim 4, wherein said second gears each includes a hand grip for allowing a user to move said second gear away from said dial and for allowing said at least two gears to be rotated freely by said dials.

6. The thread tension device according to claim 4, wherein said second gears each includes a protrusion, said recovering means includes at least two rotary members rotatably supported in the sewing machine for engaging with said protrusions of said second gears and for recovering said protrusions and said second gears.

7. The thread tension device according to claim 6, wherein said recovering means includes a third gear rotatably supported in the sewing machine, a fourth gear secured on said rod and engaged with said third gear for allowing said third gear to rotate said rod and said rod and said at least two cams.

8. The thread tension device according to claim 6, wherein said recovering means includes a third gear rotatably supported in the sewing machine and an actuator rotatably secured to said rod for engaging with said at least two rotary members, said actuator includes a projection for engaging with said third gear, and means for biasing said projection to engage with said third gear and for allowing said third gear to rotate said actuator and for allowing said actuator to actuate said at least two rotary members simultaneously.

9. The thread tension device according to claim 8, wherein said actuator includes at least two screws threadedly engaged thereon for engaging with said at least two rotary members, said at least two screws are adapted to be adjusted relative to said actuator.

10. The thread tension device according to claim 8, wherein said recovering means includes two arms rotatably engaged on said rod, said actuator is secured to said arms and rotated in concert with said arms.

11. A thread tension device for a sewing machine, said thread tension device comprising:

at least two poles provided in the sewing machine, two pairs of discs engaged on said at least two poles respectively for clamping threads, at least two first biasing means engaged with said pairs of discs respectively for applying a biasing force against said pairs of discs and for applying thread tensions to the threads, at least two micro-adjusting mechanisms engaged with said at least two first biasing means for adjusting the biasing force of said at least two first biasing means against said pairs of discs, a recovering means for actuating said at least two micro-adjusting mechanisms simultaneously and for allowing said at least two micro-adjusting mechanisms to be recovered to an original position, and means for adjusting the biasing force of said at least two first biasing means against said pairs of discs, said at least two micro-adjusting mechanisms including at least two dials engaged with said at least two first biasing means, said at least two dials each including a protrusion, said recovering means including at least two rotary members rotatably supported in the sewing machine for engaging with said protrusions of said at least two dials and for recovering said protrusions and said at least two dials.

12. The thread tension device according to claim 11, wherein said recovering means includes a rod rotatably supported in the sewing machine, a first gear rotatably supported in the sewing machine and an actuator rotatably secured to said rod for engaging with said at least two rotary member, said actuator includes a projection for engaging with said first gear, and means for biasing said projection to engage with said first gear and for allowing said first gear to rotate said actuator and for allowing said actuator to actuate said at least two rotary members simultaneously.

13. The thread tension device according to claim 12, wherein said actuator includes at least two screws threadably engaged thereon for engaging with said at least two rotary members, said at least two screws are adapted to be adjusted relative to said actuator.

14. The thread tension device according to claim 12, wherein said recovering means includes two arms rotatably engaged on said rod, said actuator is secured to said arms and rotated in concert with said arms.

15. The thread tension device according to claim 12, wherein said at least two dials each includes an internal gear, and a second gear engaged with said internal gear, and means for biasing said second gear to engage with said internal gear and for allowing said second gear to be disengaged from said dial, said protrusion are extended from said second gears.

16. The thread tension device according to claim 15, wherein said second gears each includes a hand grip for allowing a user to move said second gear away from said dial.

* * * * *